US006840065B1

(12) United States Patent
Wang

(10) Patent No.: US 6,840,065 B1
(45) Date of Patent: Jan. 11, 2005

(54) SINKER OF CIRCULAR KNITTING MACHINES FOR PILE FABRICS

(75) Inventor: Ping-Shih Wang, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 10/759,306

(22) Filed: Jan. 20, 2004

(51) Int. Cl.[7] ..... D04B 15/06
(52) U.S. Cl. ..... 66/93; 66/107
(58) Field of Search ..... 66/90–93, 104, 66/105, 106, 107, 108 A, 108 R

(56) References Cited

U.S. PATENT DOCUMENTS 4,194,374 A * 3/1980 Guell ..... 66/93
4,955,211 A * 9/1990 Neher ..... 66/9 R
5,477,707 A * 12/1995 Renda et al. ..... 66/93
6,321,575 B1 * 11/2001 Sangiacomo ..... 66/93
6,715,325 B2 * 4/2004 Sangiacomo ..... 66/107

* cited by examiner

*Primary Examiner*—Danny Worrell
(74) *Attorney, Agent, or Firm*—Birch, Stewart, Kolasch & Birch, LLP

(57) ABSTRACT

A sinker of circular knitting machines for pile fabrics, which is used in the circular knitting machine assembly has an aslant contact surface between a sinker cylinder and a cam. By the aslant surface disposed on a nose section of the sinker, the bottom yarn can fall accordingly and constitutes a perfect plating loop effect with the binding yarn. Further a first end surface of a throat section and the second end surface of an abdominal section are designed with different inclined angles to cope with the movement of a sinker cylinder of a circular knitting machine having an aslant surface. Therefore, the knitting needle and the sinker on the circular knitting machine can maintain a smooth knitting movement.

8 Claims, 10 Drawing Sheets

SINKER OF CIRCULAR KNITTING MACHINES FOR PILE FABRICS

FIELD OF THE INVENTION

The present invention relates to a sinker of circular knitting machines for pile fabrics, and more particularly to a sinker for circular knitting machines that provides a yarn positioning function during the knitting process.

BACKGROUND OF THE INVENTION

Please refer to FIG. 1 for a conventional sinker of circular knitting machines for pile fabrics. The conventional sinker 31 comprises a nose section 32, support surface 33 being a horizontal surface disposed on the nose section 32, and when the sinker 31 draws back in the final step of the knitting process, the knitting needle 34 pulls the bottom yarn and the binding yarn of a yarn loop 35 down. Since the support surface 33 does not have an inclined angle it is difficult to maintain the angle of a plating loop when the yarn loop falls. In other words, the angle of the plating loop is changed very easily when the yarn loop falls, and thus will cause low quality of fabrics.

Further, the sinker cylinder containing the sinker is rotated at a high speed for knitting. Therefore, the sinker moves back and forth in the driving path of the cam during high-speed rotation. When the sinker cylinder rotates at a high speed, a centrifugal force is produced to give the sinker a large outwards swinging force towards the exterior of the circular knitting machine, such that a protruded plate cannot loop smoothly along the driving path. The contact surface and contact angle of the protruded plate in the driving path form several stress focal points which are worn repeatedly by the centrifugal force. The wear between the sinker and cam shortens their lifetime, and also increases the cost of manufacture which in turn is passed onto the consumer. Furthermore, the sinker cylinder contains thousands of sinkers, operators have to examine and replace them frequently, thus seriously affecting productivity.

It is necessary to improve the shortcomings of the aforementioned circular knitting machine which is not cost-effective or efficient. The design of the present invention can overcome the foregoing shortcomings and improvements upon the prior art.

SUMMARY OF THE INVENTION

The primary objective of the present invention is to provide a sinker with a perfect plating loop whilst knitting pile fabrics.

By designing an aslant surface on the nose section of the sinker; a perfect angle for the plating loop can be achieved by separating the old yarn ring from the aslant surface of the nose section when the knitting needle pulls the binding yarn and the bottom yarn lower than the abdominal section of the sinker.

Another objective of the present invention is to provide a sinker assembly for circular knitting machines.

The sinker comprises a first end surface disposed at its throat section and a second end surface disposed at its abdominal section. Since the contact surface between the cam and the sinker cylinder of the circular knitting machine is designed to be aslant, therefore the sinker is installed onto the circular knitting machine with an inclined angle. After the sinker is installed, the first end surface is horizontal and the second end surface is aslant.

As the weaving angle and yarn angle are taken into consideration for the knitting process, the sinker of the circular knitting machine designed with the aslant feature is redesigned according to the principal of knitting movements for operating the circular knitting machines.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The detailed description and technical characteristics of the present invention are described together with the drawings as follows.

Figure 1:
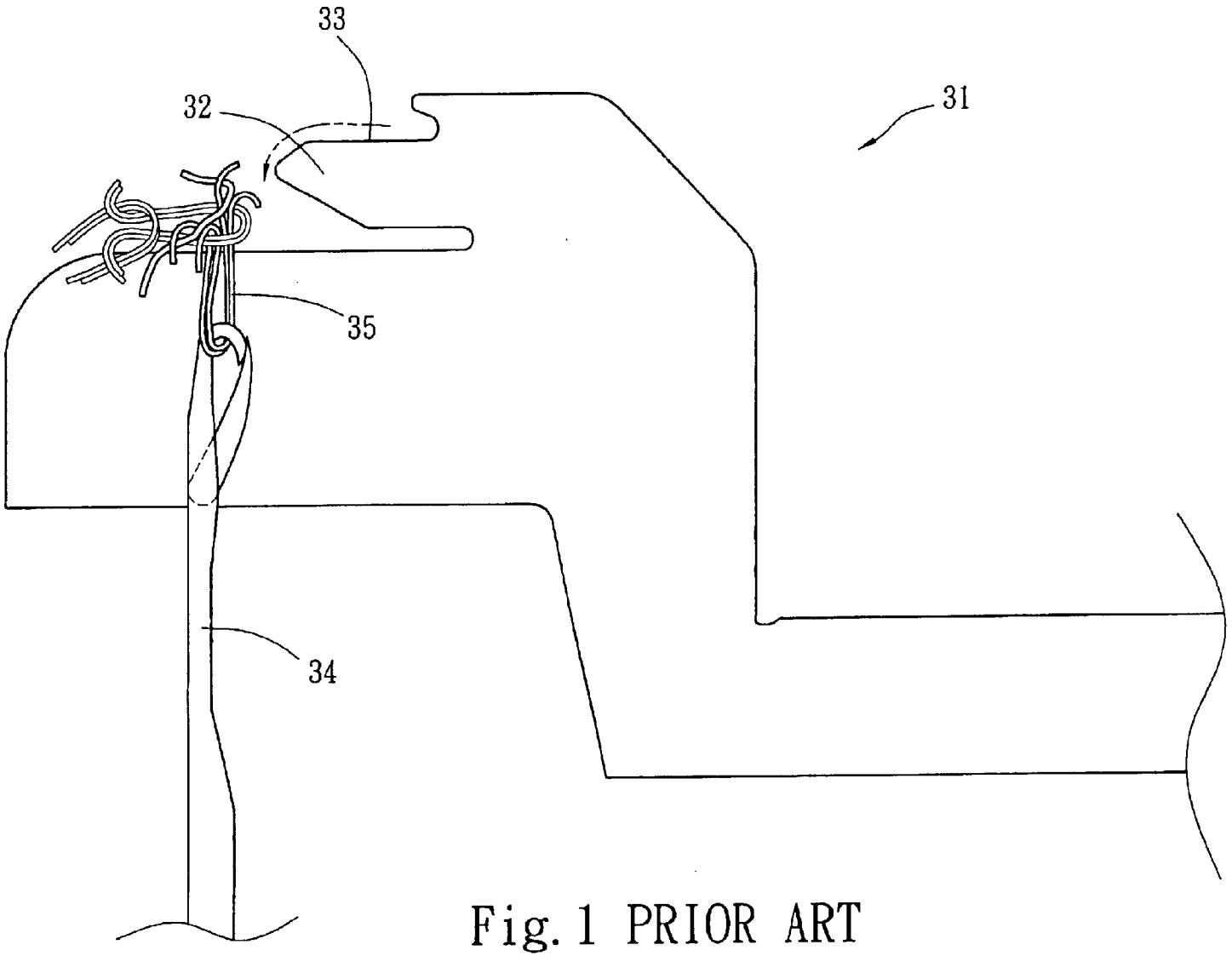
Fig. 1 PRIOR ART
FIG. 1 is a view of the movement of the plating loop of the prior art sinker.
Figure 2:
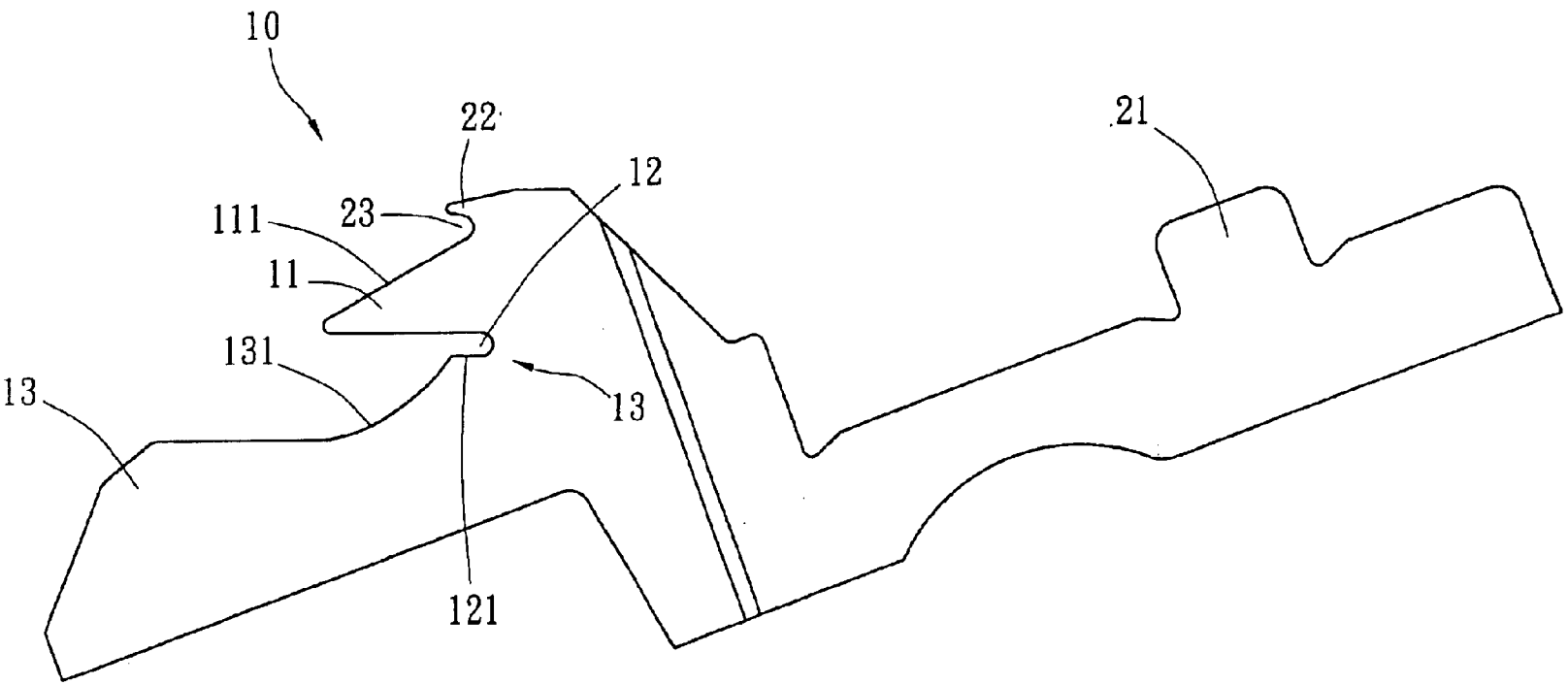
FIG. 2 is a planar view of the appearance of the sinker according to the present invention.

Please refer to FIG. 2 for a preferred embodiment of this invention. In the figure, a sinker 10 comprises a nose section 11, a protruded nose 22, a throat section 12, and an abdominal section 13; wherein the nose section 11 has an aslant surface 111; the throat section 12 has a first end surface 121; the abdominal section 13 has a second end surface 131 on one side; and the limit groove 23 is disposed between the nose section 11 and the protruded nose 22.

Figure 3:
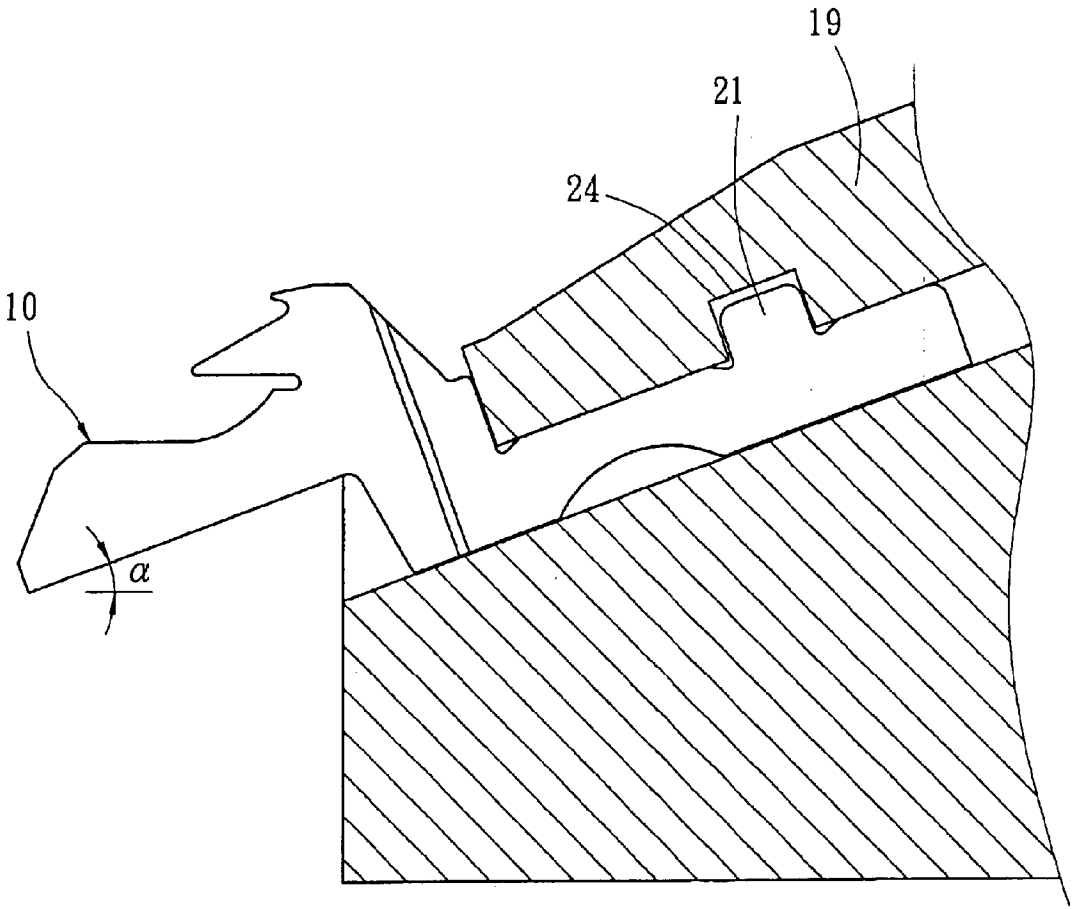
FIG. 3 is a side view of the sinker according to a preferred embodiment of the present invention.

Please refer to FIG. 3. The sinker 10 is installed on the driving path 24 (which is a track disposed between the take-up cam and take-down cam for driving a knitting needle for the vertical movement of the needle) of a cam 19 of the circular knitting machine by the protruded plate 21. Since the contact surface between the cam 19 and the sinker cylinder is inclined to an angle $\alpha$, therefore when the sinker 10 is installed onto the contact surface, the sinker is also inclined to an angle $\alpha$, and the first end surface 121 is in a horizontal position.

Please refer to FIGS. 4A–4G for the movements of the sinker 10 and the knitting needle 14 in the weaving process. Please refer to FIG. 4A first. A knitting needle 14 pulls a yarn loop 17 composed of a binding yarn 20 and a bottom yarn 16 down (see FIG. 4B), while the sinker 10 is moving forward and the knitting needle 14 moves upwards for the take-up. Please refer to FIG. 4B. The knitting needle 14 hooks the wool yarn 18 and prepares for the downward pulling movement. Then, the yarn loop 17 falls to the root section of the knitting needle 14, and opens a latch needle 141.

Figure 4A:
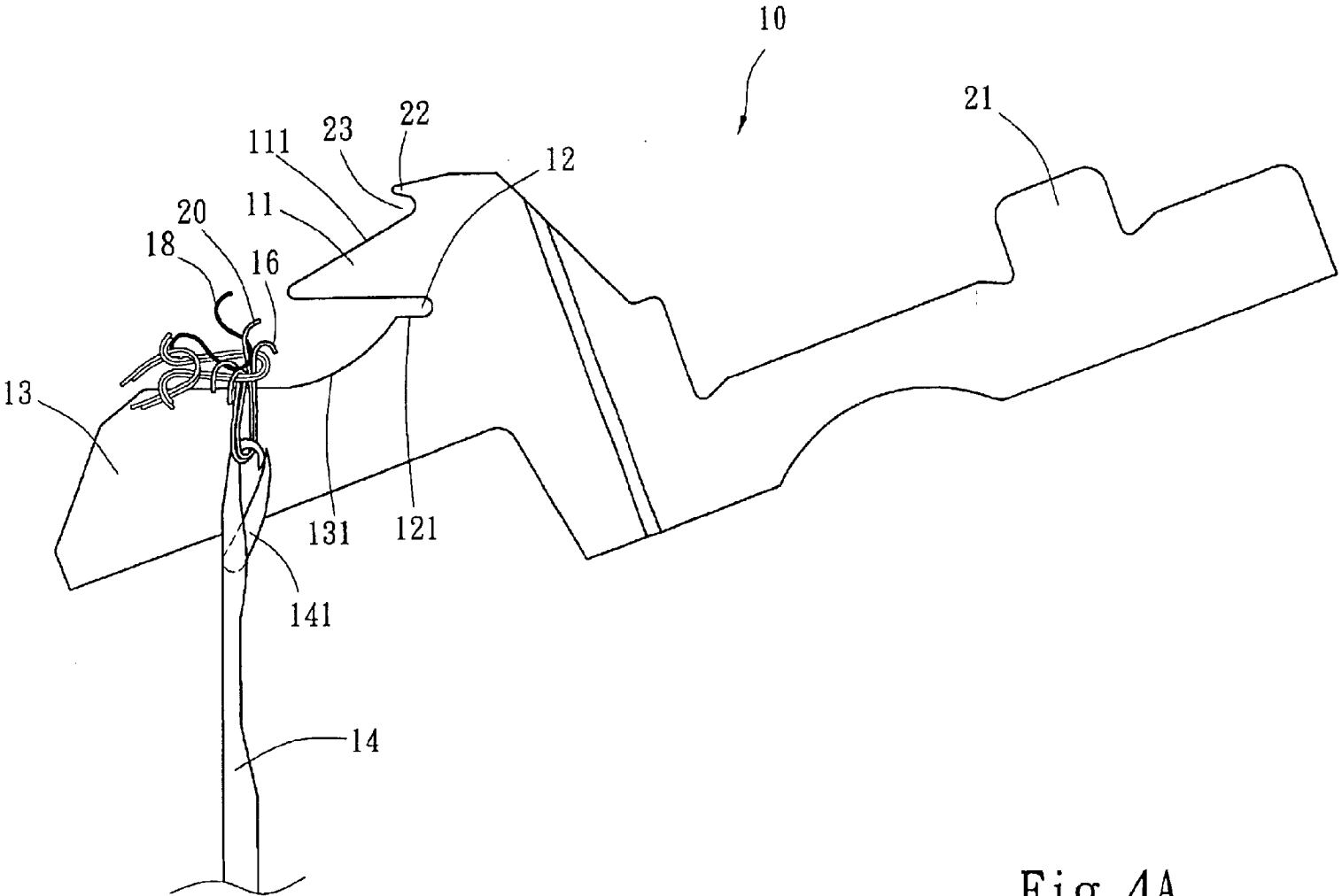
FIGS. 4A–4G are views of the movement of the sinker in the knitting process according to the present invention.
Figure 4B:
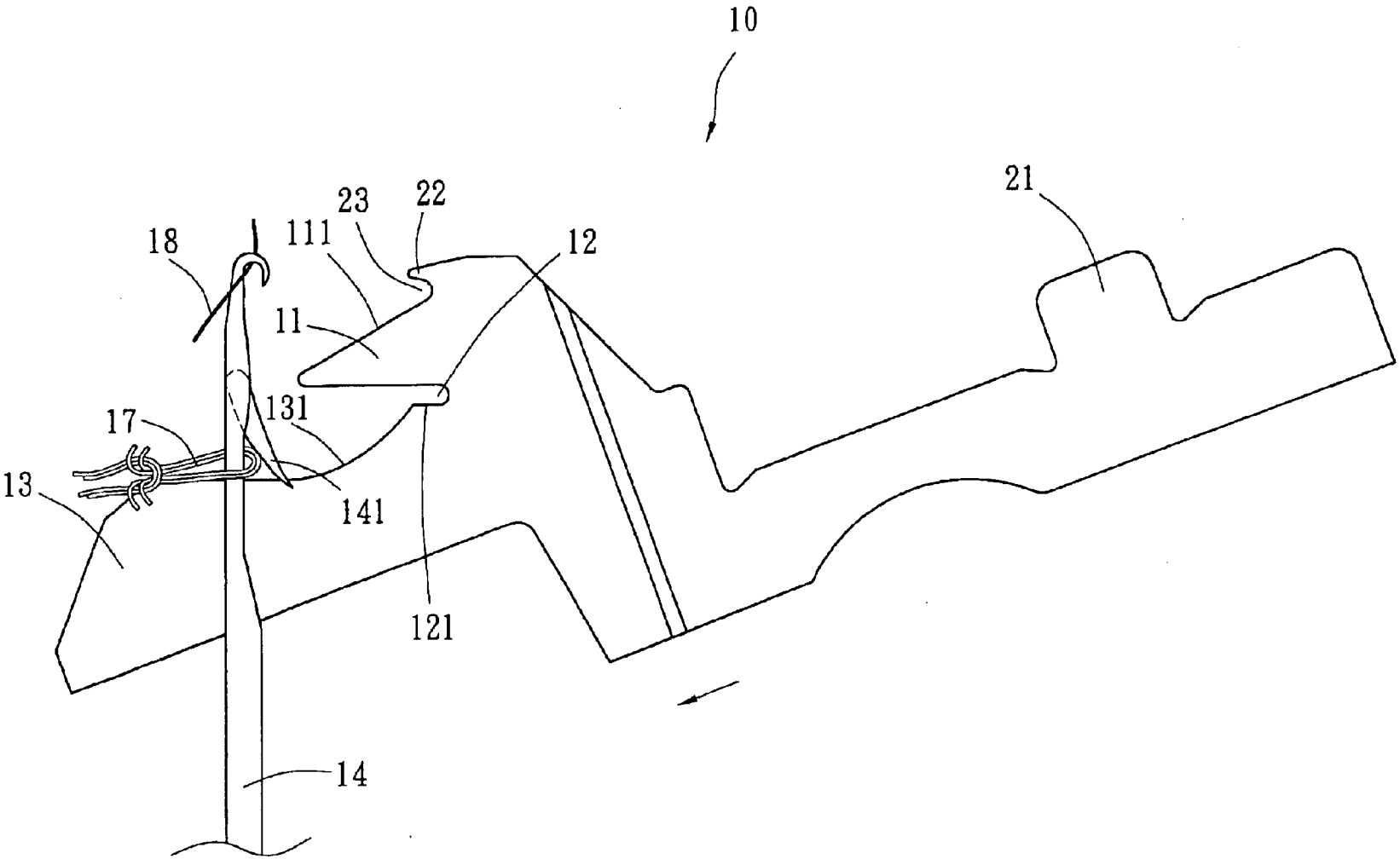
Figure 4C:
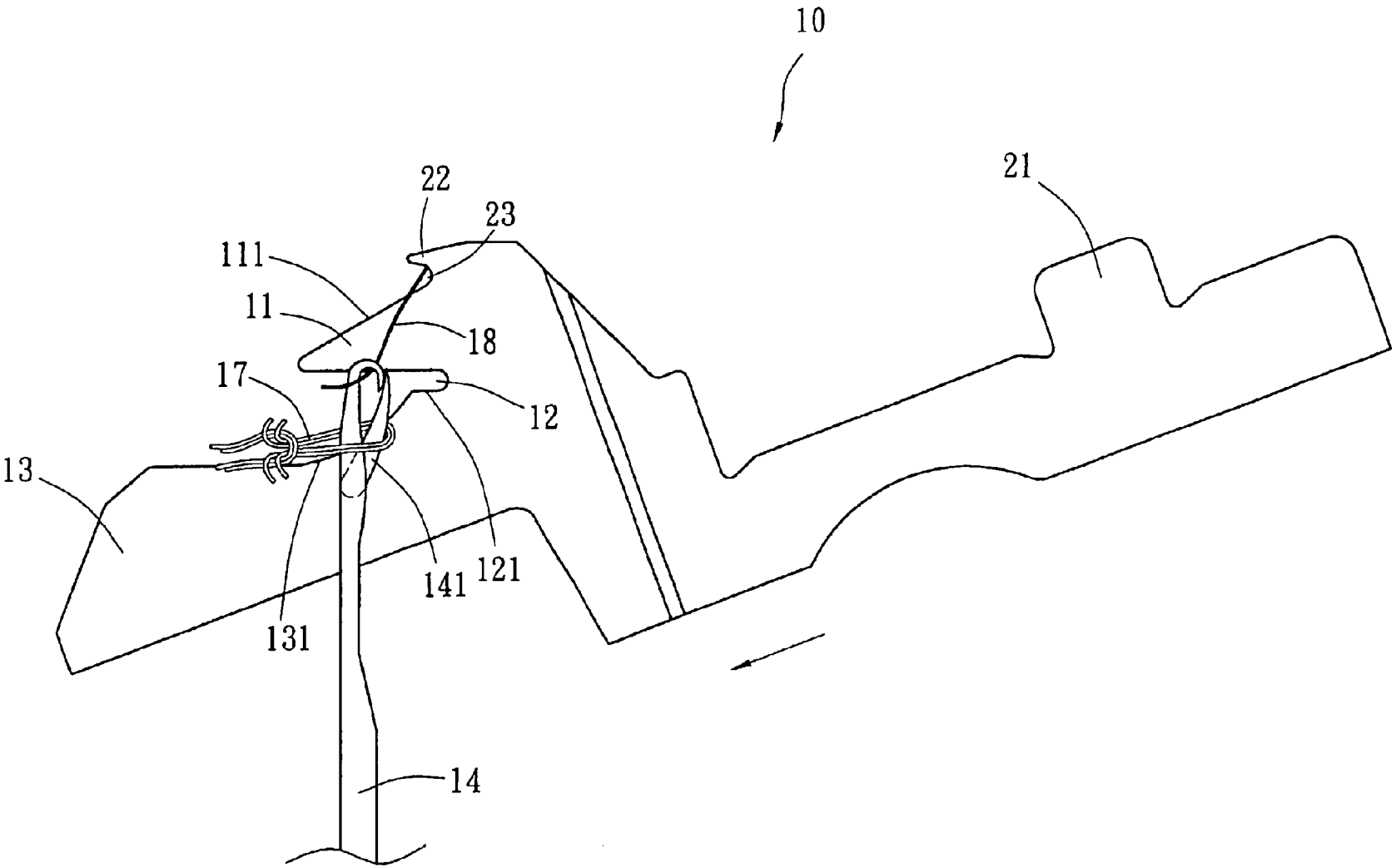
Figure 4D:
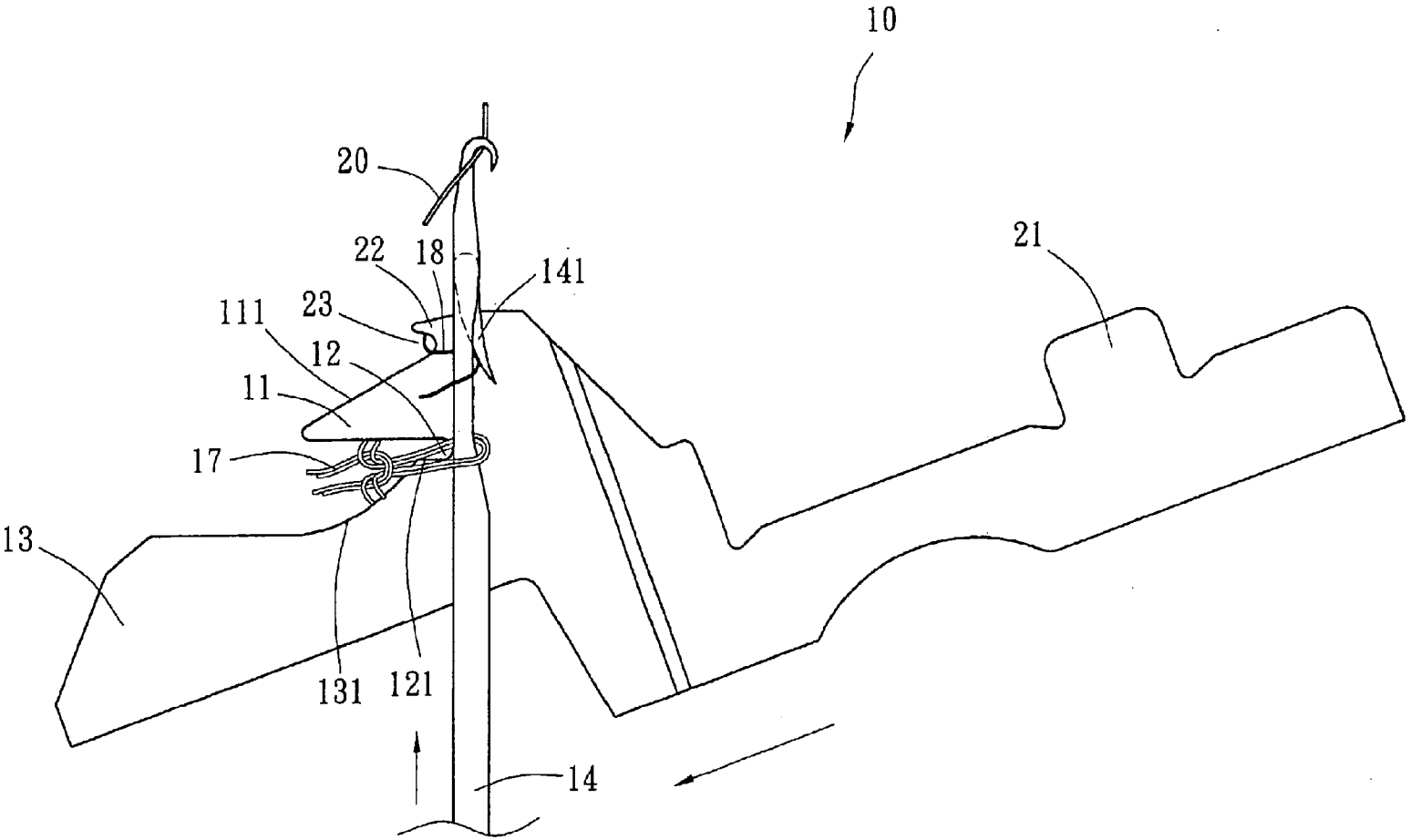

Please refer to FIG. 4C. The knitting needle 14 pulls down the wool yarn 18 while the sinker 10 continues to move forward, such that the wool yarn 18 drives and hangs on a limit groove 23 between the nose section 11 and the protruded nose 22 of the sinker 10. Please refer to FIG. 4D. The knitting needle 14 is protruded upward, such that the wool yarn 18 opens the latch needle 141 and casts off to fall to the bottom of the latch needle 141 of the knitting needle 14. The yarn loop 17 composed of binding yarn 20 and the bottom yarn 16 at the bottom of the latch needle 141 of the knitting needle 14 (as shown in FIG. 4A) further falls downward. Then, the knitting needle 14 hooks the binding yarn 20 and prepares to pull down the binding yarn 20.

Figure 4E:
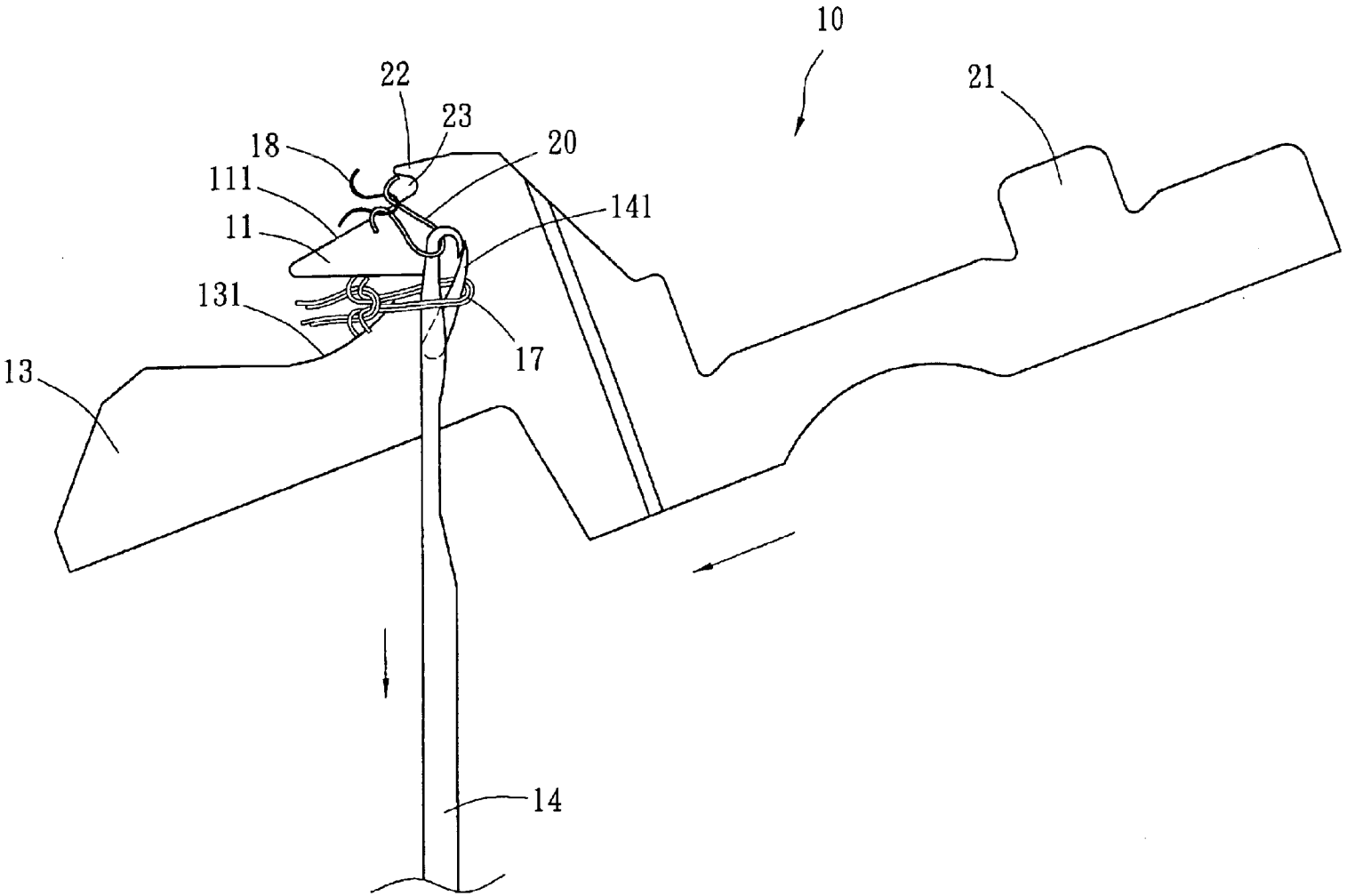

Please refer to FIG. 4E. When the knitting needle 14 drives the binding yarn 20 to move downwards, the sinker 10 continues to move forward, and the latch needle 141 was closed by the upward movement of the yarn loop 17 to connect the wool yarn 18 and the binding yarn 20 into a string.

Figure 4F:
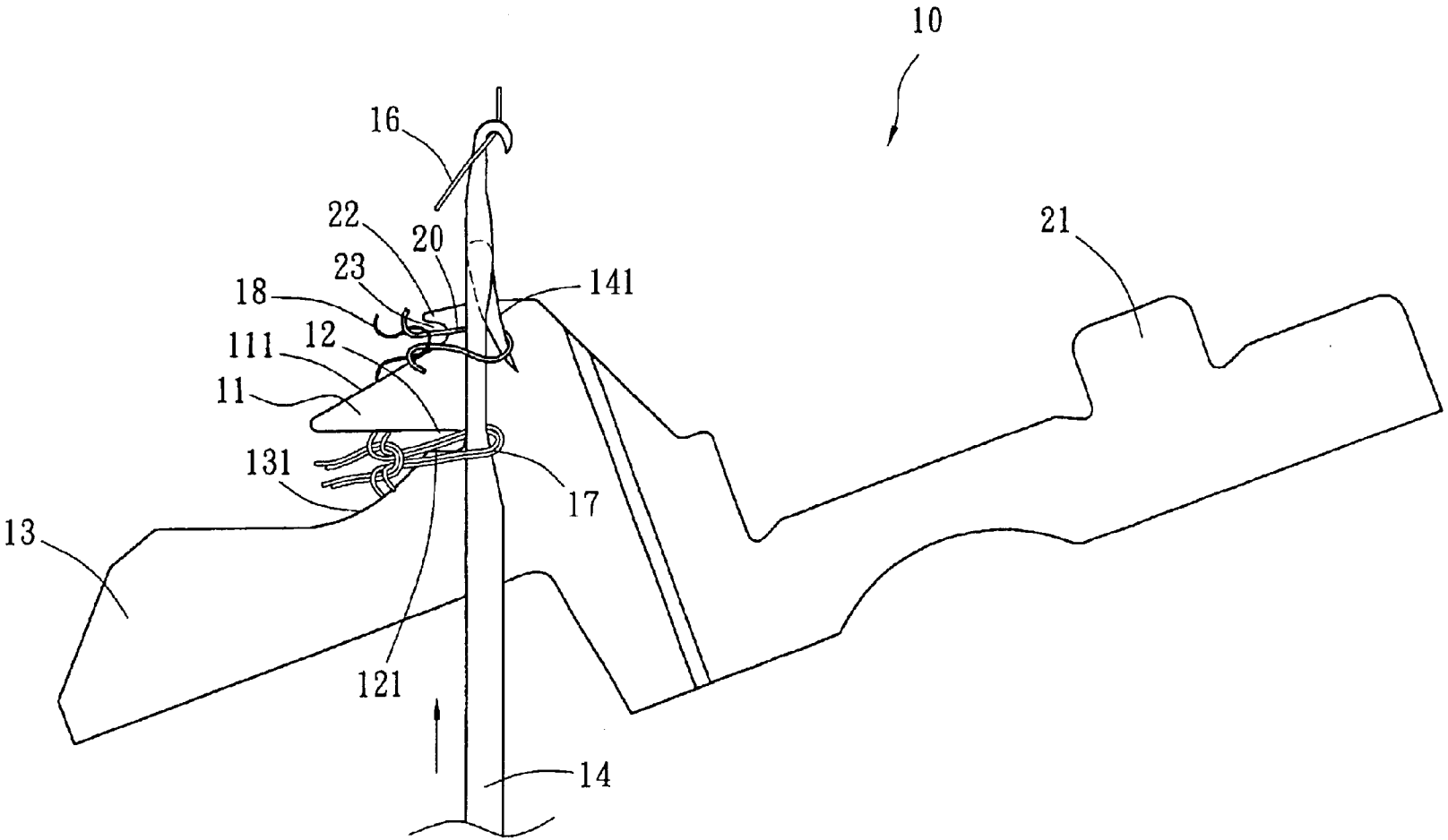

Please refer to FIG. 4F. The wool yarn 18 and the binding yarn 20 still hook into the limit groove 23 between the nose section 11 and the protruded nose 22 of the sinker 10 after the wool yarn 18 and the binding yarn 20 are connected with each other into a string. Then, the knitting needle 14 continues to move upward halfway, so that the wool yarn 18 and the binding yarn 20 fall to open the latch needle 141, and the knitting needle 14 hooks a bottom yarn 16, and then the yarn 17 falls down further.

Figure 4G:
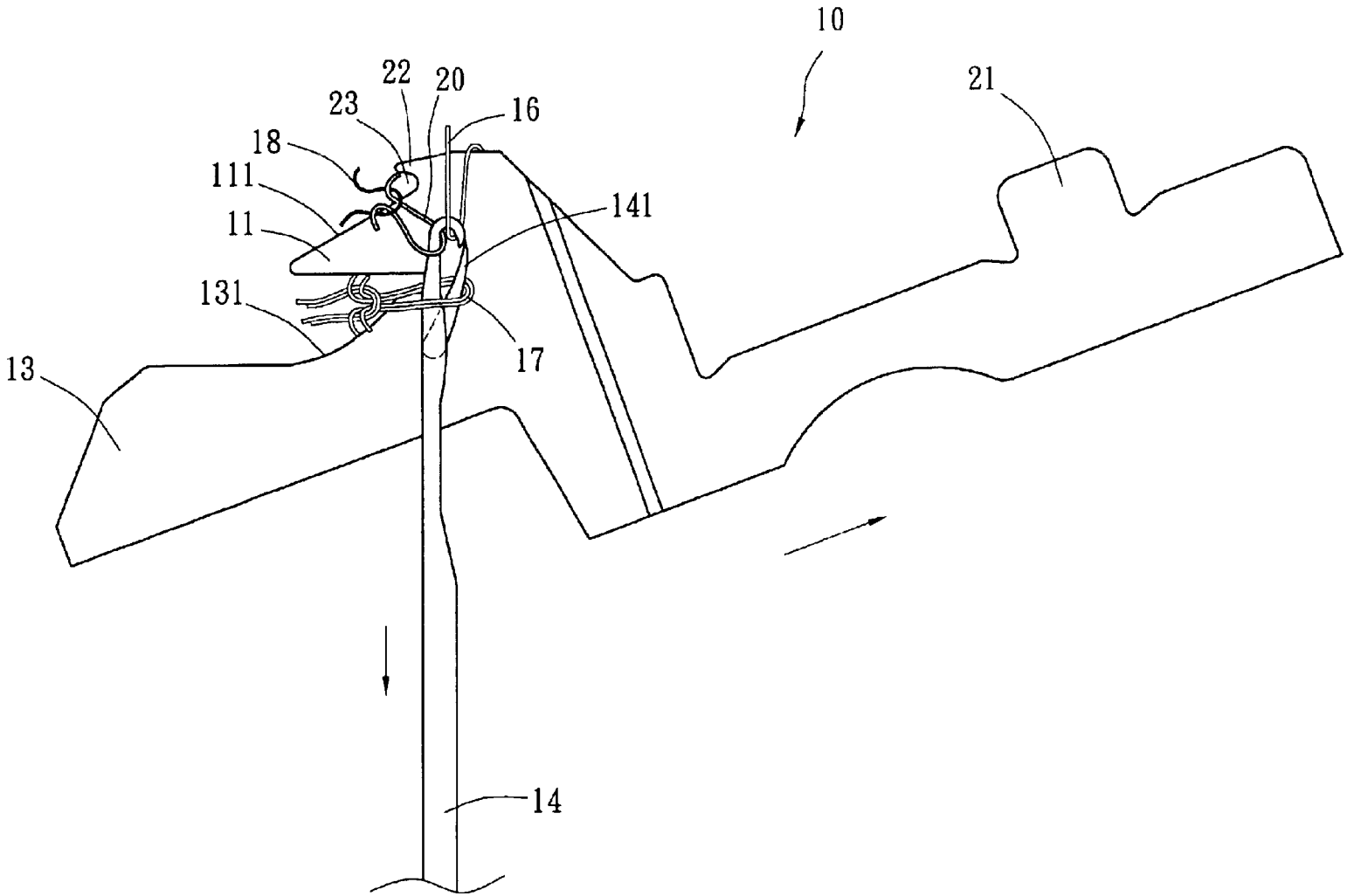

Please refer to FIG. 4G. The sinker 10 draws back to pull the knitting needle 14 down, and also pulls the binding yarn 20 and the bottom yarn 16 connected to the wool yarn 18 down. The yarn loop 17 composed of the binding yarn 20 and the bottom yarn 16 (as shown in FIG. 4A) binds the binding yarn 20 and the bottom yarn 16 together to form a yarn loop 17. As the sinker 10 draws back to let the yarn loop 17 composed of the binding yarn 20 and the bottom yarn 16 falls along the aslant surface 111 of the nose section 11 onto the second end plane 131 of the abdominal section 13 of the sinker 10. The aslant surface 111 allows the yarn loop 17 to have a better angle for the plating loop.

The above procedure is repeated to achieve the purpose of knitting fabrics with the sinker 10 and the knitting needle 14.

While the invention has been described by way of example and in terms of a preferred embodiment, it is to be understood that the invention is not limited thereto. The contrary, it is intended to cover various modifications and similar arrangements and procedures, and the scope of the appended claims therefore should be accorded the broadest interpretation so as to encompass all such modifications and similar arrangements and procedures.

What is claimed is:

1. A sinker of circular knitting machines for pile fabrics, being disposed on a circular knitting machine with an inclined angle for providing a positioning loop for a wool yarn, a bottom yarn, and a binding yarn, comprising:

a nose section, having a protruded nose coupled to one end of the nose section;

a throat section, disposed at a position adjacent to another end of said nose section; and an abdominal section coupled to said throat section, and said nose section having an aslant surface which provides a downward pulling on said bottom yarn and binding yarn in a knitting process to achieve a plating loop, the sinker being movable in an inclined direction during the knitting process.

2. The sinker of circular knitting machines for pile fabrics of claim 1, wherein said throat section comprises a first end surface, and said abdominal section comprises a second end surface, and said first end surface is coupled to said second end surface, and said first end surface is an aslant surface, such that said first end surface is a horizontal surface when said sinker is disposed in said circular knitting machine.

3. The sinker of circular knitting machine for pile fabrics of claim 1, further comprising a limit groove for positioning said wool yarn, bottom yarn, and binding yarn, the limit groove being disposed at a position between said protruded nose and nose section.

4. The sinker of circular knitting machine for pile fabrics of claim 1, further comprising a limit groove positioned between the protruded nose and the nose section, the aslant surface of the nose section being a smooth, flat surface which extends from the limit groove.

5. The sinker of circular knitting machine for pile fabrics of claim 4, wherein the aslant surface of the nose section extends at an inclined, non-horizontal direction when the sinker is disposed in the circular knitting machine.

6. The sinker of circular knitting machine for pile fabrics of claim 5, wherein the throat section has a first end surface, the first end surface is a horizontal surface when the sinker is disposed in the circular knitting machine.

7. The sinker of circular knitting machine for pile fabrics of claim 1, wherein the nose section has a rounded end and wherein an undersurface of the nose section is a smooth, flat surface which extends from the rounded end to the throat section.

8. The sinker of circular knitting machine for pile fabrics of claim 1, wherein the throat section has a first end surface and the abdominal section has a second end surface, the second end surface extending from the first end surface and being a concave curved surface.

* * * * *